US011162508B2

(12) United States Patent
Lin et al.

(10) Patent No.: US 11,162,508 B2
(45) Date of Patent: Nov. 2, 2021

(54) CENTRIFUGAL FAN AND FAN WHEEL THEREOF

(71) Applicant: ASUSTEK COMPUTER INC., Taipei (TW)

(72) Inventors: Hsin-Chen Lin, Taipei (TW); Ing-Jer Chiou, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 92 days.

(21) Appl. No.: 16/736,108

(22) Filed: Jan. 7, 2020

(65) Prior Publication Data

US 2020/0224672 A1 Jul. 16, 2020

(30) Foreign Application Priority Data

Jan. 11, 2019 (TW) ..... 108101220

(51) Int. Cl.
*F04D 29/38* (2006.01)
*F04D 29/42* (2006.01)
*F04D 29/28* (2006.01)

(52) U.S. Cl.
CPC ..... *F04D 29/388* (2013.01); *F04D 29/281* (2013.01); *F04D 29/4253* (2013.01)

(58) Field of Classification Search
CPC ..... F04D 29/281; F04D 29/388
See application file for complete search history.

(56) References Cited

U.S. PATENT DOCUMENTS 6,579,064 B2 * 6/2003 Hsieh ..... F04D 29/30 416/179
6,648,602 B2 * 11/2003 Horng ..... F04D 29/327 416/203
7,997,871 B2 8/2011 Hwang et al.

FOREIGN PATENT DOCUMENTS

| | | | |
|---|---|---|---|
| CN | 2531148 | Y | 1/2003 |
| CN | 101358607 | A | 2/2009 |
| CN | 204498539 | U | 7/2015 |
| CN | 206943083 | U | 1/2018 |
| TW | M500164 | U | 5/2015 |

OTHER PUBLICATIONS

Office Action issued in corresponding CN application No. 201910485261.X dated Jan. 5, 2021.

* cited by examiner

*Primary Examiner* — Woody A Lee, Jr.
*Assistant Examiner* — Brian O Peters
(74) *Attorney, Agent, or Firm* — Muncy, Geissler, Olds & Lowe, P.C.

(57) ABSTRACT

A centrifugal fan includes a housing, a hub and a plurality of blade sets. The housing includes an air outlet and at least one air inlet. The hub is rotatably disposed in the housing. The plurality of blade sets is arranged around the hub at intervals, and each of the blade sets includes at least three blades with different shapes.

8 Claims, 10 Drawing Sheets

CENTRIFUGAL FAN AND FAN WHEEL THEREOF

CROSS-REFERENCE TO RELATED APPLICATION

This application claims the priority benefit of Taiwan Application Serial No. 108101220, filed on Jan. 11, 2019. The entirety of the above-mentioned patent application is hereby incorporated by reference herein and made a part of the specification.

BACKGROUND OF THE INVENTION

Field of the Invention

The disclosure relates to a fan, and particularly relates to a centrifugal fan and a fan wheel thereof.

Description of the Related Art

A centrifugal fan is a heat dissipation device usually used for an electronic system.

As electronic systems develop toward lightweight and thin designs, an allowable space between upper and lower covers of the centrifugal fan for setting the air inlet channel becomes smaller due to the limited room inside the electronic system. An air flow inside the narrow air inlet channel of the system needs to pass through plural air inlets located on the upper and lower covers of the centrifugal fan before it can flow to the fan. A narrower air inlet channel would lead to an increase in the flow speed of the air flow at the air inlet, and it is quite possible that a high-speed air flow would hit blades of the fan too hard and thus generate unexpected noises.

For a conventional centrifugal fan, because the rotation speed of the fan is usually constant and the distance between every two neighboring blades is fix, the hitting at the blades by the high-speed air flow would form a notorious noise at a particular frequency, which is generally referred as a blade pass tone.

BRIEF SUMMARY OF THE INVENTION

The disclosure provides a centrifugal fan. The centrifugal fan includes a housing, a hub, and a plurality of blade sets. The housing includes an air outlet and at least one air inlet. The hub is rotatably disposed in the housing. The plurality of blade sets is arranged around the hub at intervals, each of the blade sets includes at least three different blades, and a change in shapes of these at least three blades corresponds to an air inlet range of the at least one air inlet.

The disclosure also provides a fan wheel. The fan wheel includes a hub and a plurality of blade sets. The plurality of blade sets is arranged around the hub at intervals, each of the blade sets includes at least three blades with different shapes, and a change in shapes of the blades corresponds to an air inlet range.

The centrifugal fan of the disclosure includes a plurality of blade sets arranged around the hub at intervals, and each of the blade sets includes at least three blades with different shapes. Thereupon, formation of audio noise at a particular frequency due to superposition of noises would be effectively avoided, when an air flow hits the blades.

Specific embodiments of the disclosure will be further described by using the following examples and drawings.

DETAILED DESCRIPTION OF THE EMBODIMENTS

Specific embodiments of the disclosure will be described in further detail below with reference to schematic drawings. The advantages and features of the disclosure will become more apparent from the following description and claims. It should be noted that the drawings are all in a very simplified form and are not drawn to accurate scale, but are merely used for convenience and clarity of description of the embodiments of the disclosure.

Figure 1:
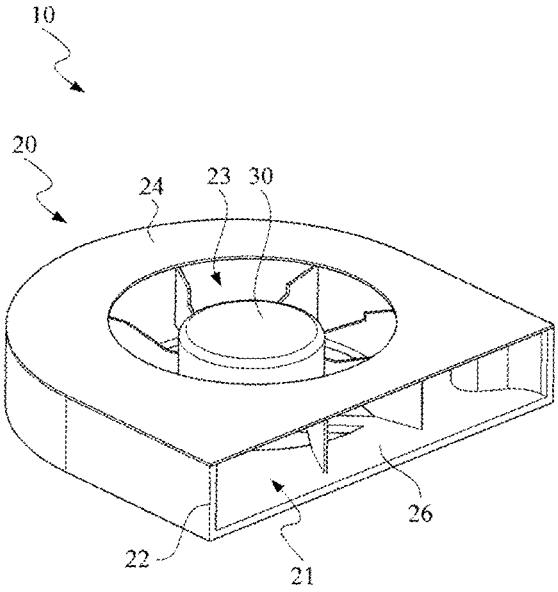
FIG. 1 is a schematic perspective view of an embodiment of a centrifugal fan according to the disclosure.
Figure 1A:
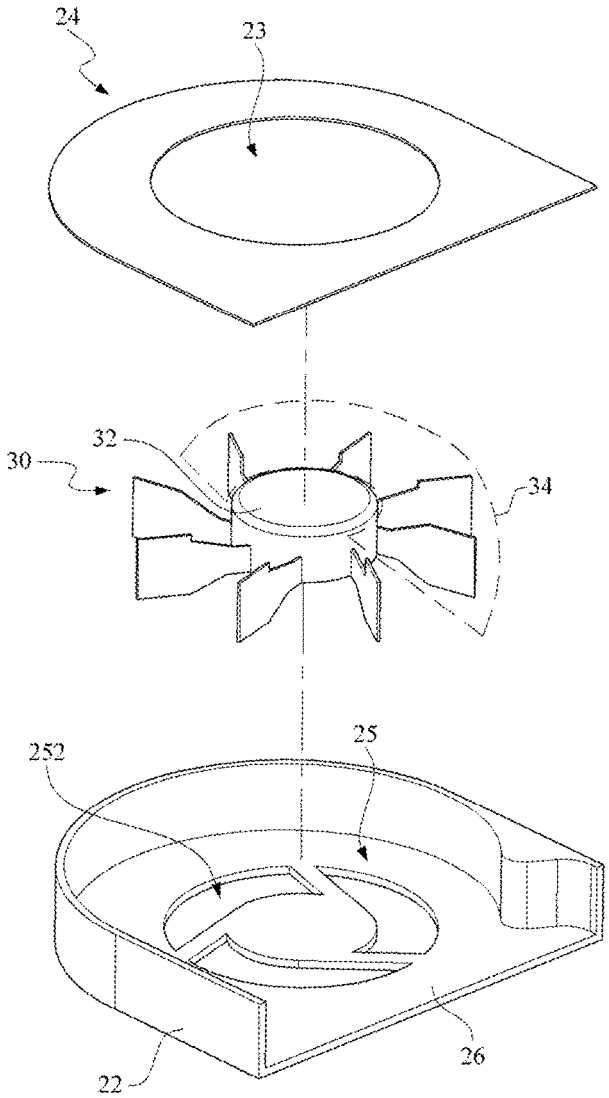
FIG. 1A is a schematic exploded view of an embodiment of a centrifugal fan according to the disclosure.
Figure 2:
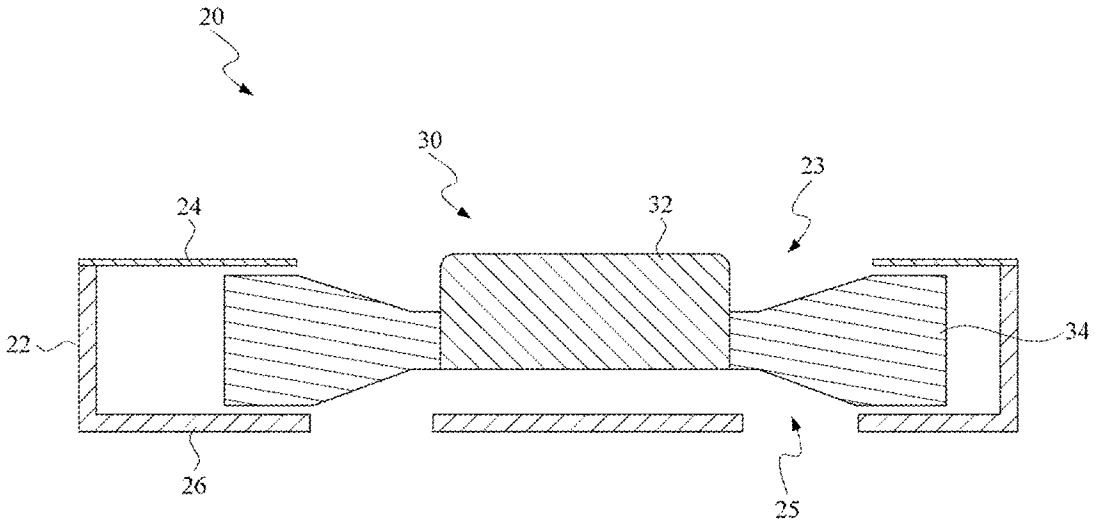
FIG. 2 is a schematic cross-sectional view of an embodiment of a centrifugal fan according to the disclosure.

FIG. 1 is a schematic perspective view of an embodiment of a centrifugal fan 10 according to the disclosure. FIG. 1A is a schematic exploded view of an embodiment of the centrifugal fan 10 according to the disclosure. FIG. 2 is a schematic cross-sectional view of an embodiment of the centrifugal fan 10 according to the disclosure. The centrifugal fan 10 is suitable for heat dissipation of an electronic system. In an embodiment, the centrifugal fan 10 is arranged inside an electronic product such as a notebook computer or a computer host so as to provide a heat dissipation capacity.

As shown in the figures, the centrifugal fan 10 includes a housing 20 and a fan wheel 30. The housing 20 includes an air outlet 21 and two air inlets 23 and 25. The air outlet 21 is located at a side wall 22 of the housing 20, and the two air inlets 23 and 25 are respectively furnished to an upper cover 24 and a lower cover 26 of the housing 20. The two air inlets 23 and 25 adopt different shapes. The air inlet 23 located at the upper cover 24 is formed as a circular opening with a radius slightly less than that of the fan wheel 30, and the air inlet 25 located at the lower cover 26 is formed as a plurality of vent holes 252 (three shown in this embodiment).

In another embodiment not shown herein, the air inlets 23 and 25 are formed at the upper cover 24 or the lower cover 26 of the housing 20 of the centrifugal fan, and the configurations of the air inlets 23 and 25 are not limited to those shown in the figures of this disclosure. Other embodiments allowing sufficient air to uniformly flow inside the housing are also applicable to the disclosure.

The fan wheel 30 includes a hub 32 and two blade sets 34 (only one of which is shown in the figures), and each of the blade sets 34 includes four blades with different shapes. The hub 32 is rotatably disposed in the housing 20. The two blade sets 34 are arranged around the hub 32 at intervals. The number of the blade sets 34 and arrangement of the blades in the blade sets 34 in this embodiment are used for clearly describing the features of the disclosure and are not intended to limit the scope of the disclosure. As a result, noise levels can be reduced by arranging a plurality of blade sets and each blade set to include at least three blades with different shapes.

The configurations, fabrications and arrangements of the blades with different shapes will be described in detail in subsequent embodiments of the blades and the fan wheel.

Figure 3:
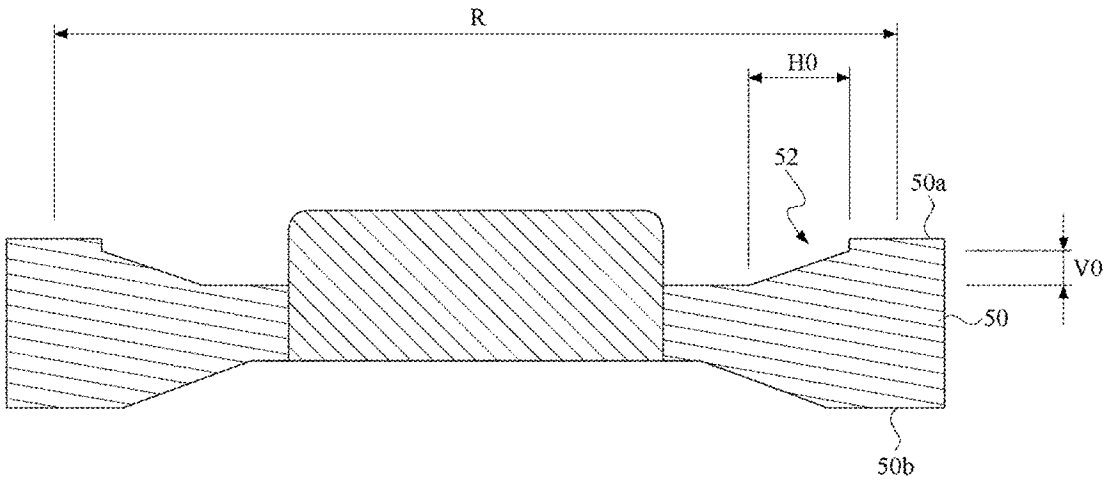
FIG. 3 is a side view of an embodiment of a blade according to the disclosure.

FIG. 3 is a side view of an embodiment of a blade 50 according to the disclosure. As shown in FIG. 3, a notch 52 is formed on the blade 50 so as to form blades 50 with different shapes. Referring to FIG. 2 and FIG. 3, the notch 52 reduces the noise generated by the high-speed air flow when the air inlets 23 and 25 hit the blades. In particular, the notch 52 corresponds to an air inlet range R of the centrifugal fan. The air inlet range R is defined by the positions and shapes of the air inlets 23 and 25, and the air inlet range R is possibly greater than the diameters of the air inlets 23 and 25. In an embodiment, a circular region corresponding to 90% of the diameter of the blade 50 is set as the air inlet range R. The shape and size of the notch 52 are changed within the range R to form blades 50 with different shapes.

As shown in the figures, in this embodiment, two variables including a horizontal variable H0 (horizontal withdrawal distance of the notch) and a vertical variable V0 (vertical withdrawal distance of the notch) of the blade 50 are adjusted to form notches 52 with different shapes and sizes. In an embodiment, the horizontal variable H0 of the notch 52 is adjusted while keeping the vertical variable V0 at a fixed value such as a maximum value, so as to form blades 50 with different shapes. In another embodiment, the vertical variable V0 of the notch 52 is adjusted while keeping the horizontal variable H0 of the notch 52 at a fixed value such as a maximum value, so as to form blades 50 with different shapes. In a further embodiment, the horizontal variable H0 and the vertical variable V0 of the notch 52 are simultaneously adjusted so as to form blades 50 with different shapes.

The disclosure is not limited to the notch shown in the figures. In some embodiments, notches of other shapes such as a V shape and a U shape are formed in the blades 50, and other variables such as notch width and notch depth are adjusted to form blades 50 with different shapes.

Secondly, as shown in the figures, in an embodiment, the notch 52 is located at an upper edge 50*a* of the blade 50. That is, the notch 52 faces the air inlet of the upper cover of the centrifugal fan. In some other embodiments, the notch 52 is located at a lower edge 50*b* of the blade 50. That is, the notch 52 faces the air inlet of the lower cover of the centrifugal fan. In some other embodiments, according to actual requirements, the notch 52 is formed in each of the upper edge 50*a* and the lower edge 50*b* of the blade 50.

Figure 4:
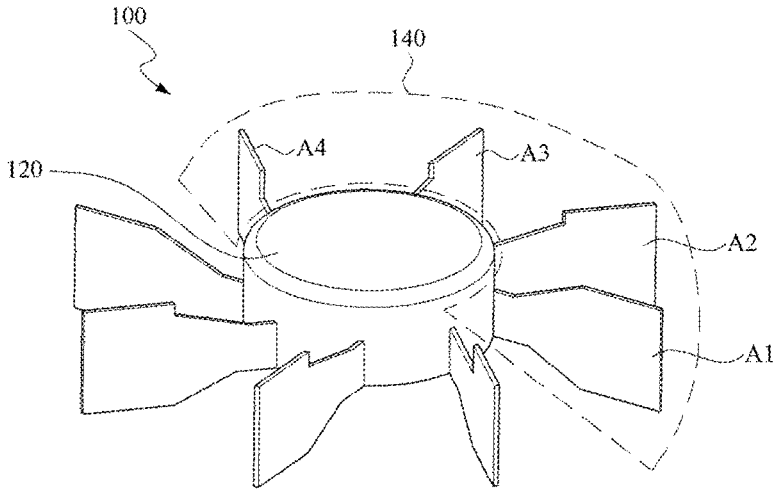
FIG. 4 is a schematic perspective view of a fan wheel according to a first embodiment of the disclosure.

FIG. 4 is a schematic perspective view of a fan wheel 100 according to an embodiment of the disclosure. In this embodiment, the fan wheel 100 includes two identical blade sets 140 that are arranged around a hub 120 at intervals. Each blade set 140 includes four blades A1, A2, A3 and A4 with different shapes. The horizontal variables H0 of the blades A1, A2, A3 and A4 are kept unchanged, and the vertical variables V0 of the blades A1, A2, A3 and A4 are varied to form notches with different shapes.

As shown in FIG. 4, the fan wheel 100 is sequentially arranged around the hub 120 in an order of the blades A1, A2, A3, A4, A1, A2, A3 and A4. That is, the blades A1, A2, A3, A4, A1, A2, A3 and A4 are periodically arranged around the hub 120. Furthermore, in an embodiment, the blades A1, A2, A3, A4, A1, A2, A3 and A4 are arranged around the hub 120 at equal intervals to ensure a balance of the fan wheel 100.

Figure 5A:
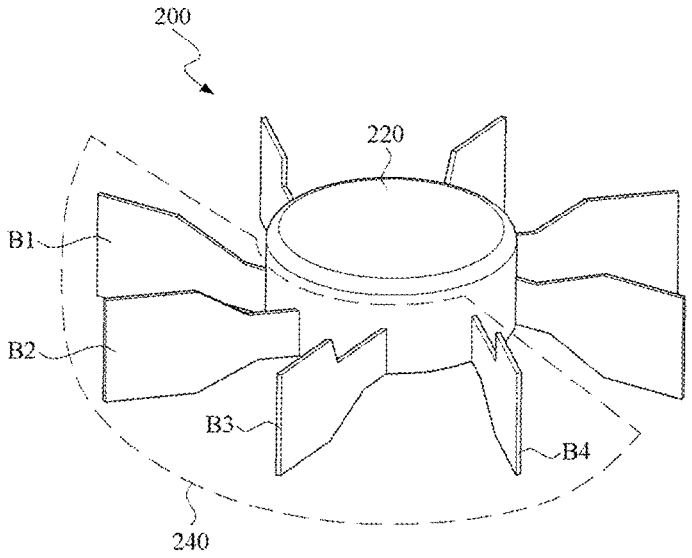
FIG. 5A and FIG. 5B are a schematic perspective view and a schematic top view of a fan wheel according to a second embodiment of the disclosure.
Figure 5B:
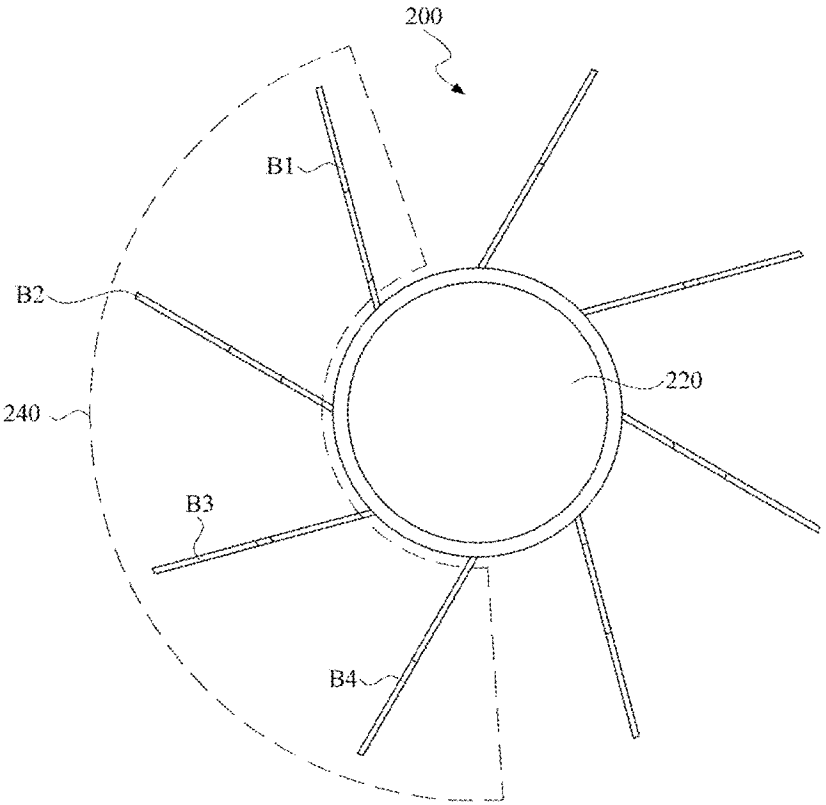

FIG. 5A and FIG. 5B are a schematic perspective view and a schematic top view of a fan wheel 200 according to a second embodiment of the disclosure. In this embodiment, the fan wheel 200 includes two identical blade sets 240 arranged around a hub 220 at intervals, and each of the blade sets 240 includes four blades B1, B2, B3 and B4 with different shapes. Different from the embodiment shown in FIG. 4, in this embodiment, the vertical variables V0 of the blades B1, B2, B3 and B4 are kept unchanged, and the horizontal variables H0 of the blades B1, B2, B3 and B4 are varied so as to form notches with different shapes. As shown in FIG. 5A and FIG. 5B, the fan wheel 200 is sequentially arranged around the hub 220 in an order of the blades B1, B2, B3, B4, B1, B2, B3 and B4.

Figure 6A:
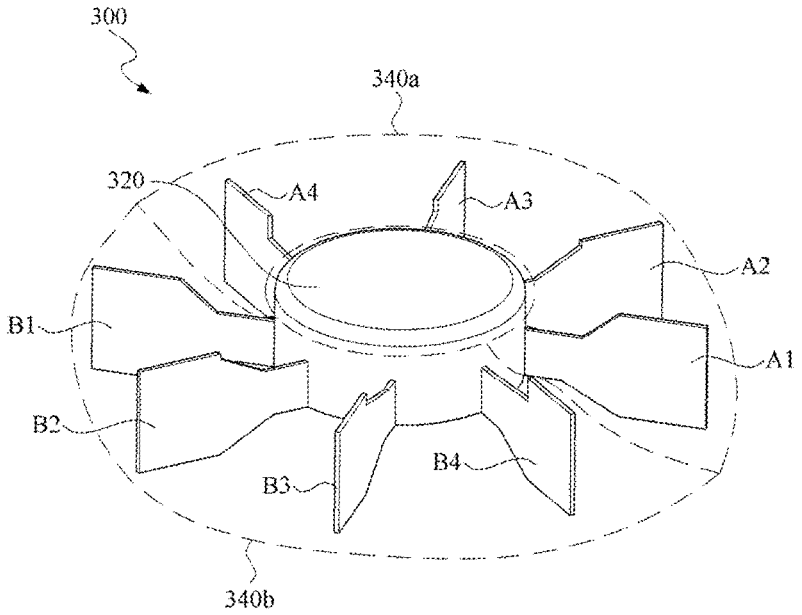
FIG. 6A and FIG. 6B are a schematic perspective view and a schematic top view of a fan wheel according to a third embodiment of the disclosure.
Figure 6B:
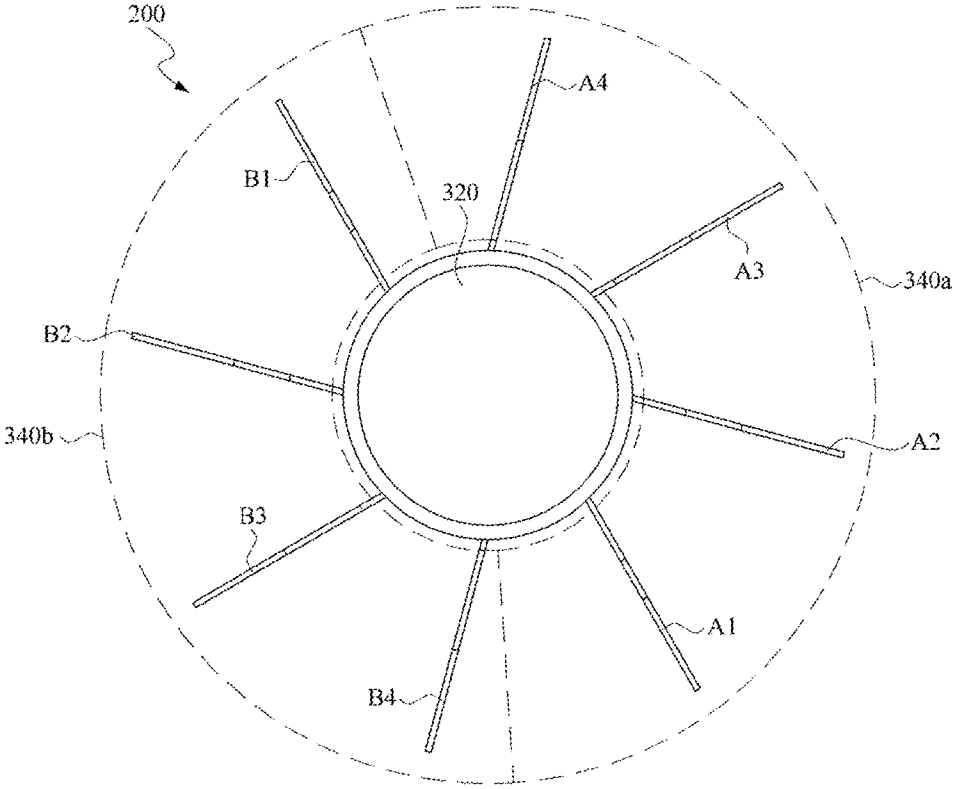

FIG. 6A and FIG. 6B are a schematic perspective view and a schematic top view of a fan wheel 300 according to a third embodiment of the disclosure. Different from the embodiments shown in FIG. 4, FIG. 5A and FIG. 5B, the fan wheel 300 of this embodiment includes two different blade sets 340*a* and 340*b* arranged around a hub 320 at intervals. The two blade sets 340*a* and 340*b* include the same number of blades but different blade shapes.

As shown in FIG. 6A and FIG. 6B, each of the two blade sets 340*a* and 340*b* includes four blades with different shapes. The horizontal variables H0 of the blades A1, A2, A3 and A4 of the blade set 340*a* are constant, and the vertical variables V0 of the blades A1, A2, A3 and A4 of the blade set 340*a* are different, such that notches of blades with different shapes can be formed. Namely, the blade set 140 according to the embodiment shown in FIG. 4 is adopted. The vertical variables V0 of the blades of the blade set 340*b* are kept constant, and the horizontal variables H0 of the blades of the blade set 340*b* are varied to form notches of blades with different shapes. That is, the blade set 240 according to the embodiment shown in FIG. 5A and FIG. 5B is adopted. As shown in FIG. 6A and FIG. 6B, the fan wheel 300 is sequentially arranged around the hub 320 is in an order of the blades A1, A2, A3, A4, B1, B2, B3 and B4.

In an embodiment, in order to ensure a balance of the fan wheel 300, the blades A1, A2, A3, A4, B1, B2, B3 and B4 are arranged around the hub 320 at equal intervals, and weights of the corresponding blades between the two blade sets 340*a* and 340*b*, such as the blades A1 and B1, are similar.

Figure 7:
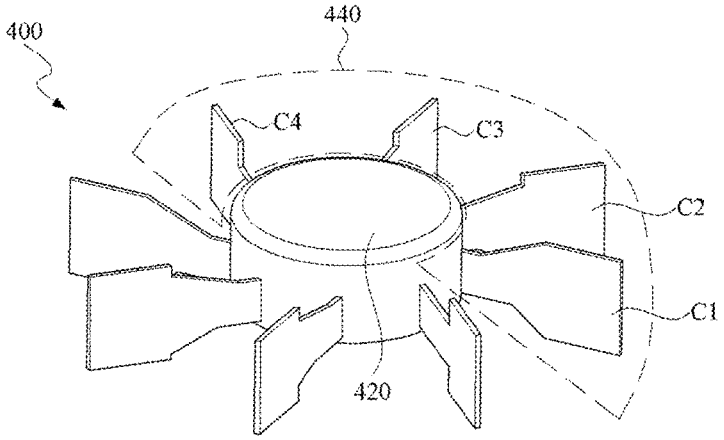
FIG. 7 is a schematic perspective view of a fan wheel according to a fourth embodiment of the disclosure.

FIG. 7 is a schematic perspective view of a fan wheel 400 according to a fourth embodiment of the disclosure. Compared with the embodiments shown in FIG. 4 to FIG. 6B in which notches are formed at the upper edges of the blades to form the blades A1, A2, A3, A4, B1, B2, B3 and B4 with different shapes, in this embodiment, the shapes of the blades are adjusted by forming notches at the upper edges and the lower edges of blades C1, C2, C3 and C4, so as to form blades C1, C2, C3 and C4 with different shapes. In addition, similar to the embodiments shown in FIG. 4 to FIG. 5B, the fan wheel 400 of this embodiment also includes two identical blade sets 440 that are arranged around a hub 420 at intervals.

The fan wheels 100, 200, 300, and 400 according to the embodiments shown in FIG. 4 to FIG. 7 respectively include two blade sets 140, 240, 340*a*, 340*b* and 440 which are respectively arranged around the hubs 120, 220, 320 and 420 at intervals, and each of the blade sets 140, 240, 340*a*, 340*b* and 440 includes four of the blades A1, A2, A3 and A4, B1, B2, B3 and B4 as well as C1, C2, C3 and C4 with different shapes. As long as there is a plurality of blade sets and each of the blade sets including at least three blades with different shapes, the number of the blade sets on the fan wheel and the numbers of blades in the blade sets are adjustable according to actual requirements.

A conventional centrifugal fan easily generates the blade pass tone during operation, which annoys the user. In contrast, the centrifugal fan of the disclosure includes a plurality of blade sets arranged around the hub at intervals, and each of the blade sets includes at least three blades with different shapes, such that the formation of audio noise at a particular frequency due to superposition of noise generated when an air flow hits the blades can be effective avoided.

The foregoing descriptions are merely preferred embodiments of the disclosure and are not intended to limit the disclosure in any way. Any person skilled in the art can make any form of equivalent replacement or modification to the technical means and technical contents disclosed by the disclosure without departing from the scope of the technical means of the disclosure, and such equivalent replacement or modification does not depart from the contents of the technical means of the disclosure and still falls within the protection scope of the disclosure.

What is claimed is:

1. A centrifugal fan, comprising:

a housing, comprising an air outlet and at least one air inlet;

a hub, rotatably disposed in the housing; and a plurality of blade sets, arranged around the hub at intervals, wherein each of the blade sets comprises at least three blades with different shapes, and each of the blade sets corresponds to an air inlet range of the at least one air inlet;

wherein each of the blades comprises a notch, and the notches on the blades of the same blade sets are of different shapes.

2. The centrifugal fan according to claim 1, wherein the blade sets are symmetrically arranged around the hub.

3. The centrifugal fan according to claim 1, wherein the notch is located at an upper edge or a lower edge of the blade.

4. The centrifugal fan according to claim 1, wherein the blades are arranged around the hub at equal intervals.

5. A fan wheel, comprising:

a hub; and a plurality of blade sets, arranged around the hub at intervals;

where each of the blade sets comprises at least three blades with different shapes, and each of the blade sets corresponds to an air inlet range;

wherein each of the blades comprises a notch, and the notches on the blades of the same blade sets are of different shapes.

6. The fan wheel according to claim 5, wherein the blade sets are symmetrically arranged around the hub.

7. The fan wheel according to claim 5, wherein the notch is located at an upper edge or a lower edge of the blade.

8. The fan wheel according to claim 5, wherein the blades are arranged around the hub at equal intervals.

* * * * *